United States Patent [19]

Thompson

[11] 4,283,897

[45] Aug. 18, 1981

[54] SNAP ACTION PANEL WALL CONSTRUCTION

[75] Inventor: LeRoy Thompson, Sewickley, Pa.

[73] Assignee: Steelite, Inc., Pittsburgh, Pa.

[21] Appl. No.: 117,500

[22] Filed: Feb. 1, 1980

Related U.S. Application Data

[63] Continuation-in-part of Ser. No. 13,910, Feb. 22, 1979, which is a continuation of Ser. No. 754,756, Dec. 27, 1976, abandoned.

[51] Int. Cl.[3] ..... E06B 3/54; E04B 2/72

[52] U.S. Cl. ..... 52/489; 52/478; 52/483; 52/520; 52/539; 52/588

[58] Field of Search ..... 52/588, 394, 478, 520, 52/521, 539, 483, 489

[56] References Cited

U.S. PATENT DOCUMENTS

| | | | |
|---|---|---|---|
| 892,248 | 6/1908 | Garvin | 52/520 |
| 1,816,556 | 7/1931 | White | 52/539 X |
| 2,128,495 | 8/1938 | Murphy | 52/520 |
| 2,325,124 | 7/1943 | Gardner | 52/521 |
| 2,620,906 | 12/1952 | Ketchum, Jr. | 52/520 |
| 2,820,535 | 1/1958 | Hutchison | 52/520 |
| 3,142,937 | 8/1964 | Ess | 52/539 |
| 3,226,901 | 1/1966 | Harter | 52/520 |
| 3,323,268 | 6/1967 | Johnson | 52/521 |
| 3,469,873 | 9/1969 | Glaros | 52/521 X |
| 3,512,222 | 5/1970 | Tinnerman | 52/520 X |
| 3,564,800 | 2/1971 | Armitage | 52/521 |
| 4,106,250 | 8/1978 | Cummings et al. | 52/539 X |
| 4,114,340 | 9/1978 | Dean et al. | 52/520 |

FOREIGN PATENT DOCUMENTS

| | | | |
|---|---|---|---|
| 548899 | 7/1956 | Belgium | 52/520 |
| 2614279 | 10/1977 | Fed. Rep. of Germany | 52/588 |
| 816860 | 8/1937 | France | 52/520 |
| 1507634 | 12/1967 | France | 52/588 |
| 2315590 | 1/1977 | France | 52/478 |
| 817238 | 7/1959 | United Kingdom | 52/520 |

*Primary Examiner*—Leslie Braun

*Attorney, Agent, or Firm*—Webb, Burden, Robinson & Webb

[57] ABSTRACT

This invention is directed to a panel wall construction comprising a plurality of hollow construction panels. The construction panels are fabricated from sheet metal to define opposite interengaging panel edges. One of said edges is arranged to receive fasteners for securing the panel wall to standards. A unique clip fits over the panel edge arranged to receive fasteners and is held in place by the fastener. The clip has a resilient tab which cooperates to provide snap action engagement of the unfastened edge of the adjacent panel with the fastened edge of the already secured panel.

2 Claims, 4 Drawing Figures

SNAP ACTION PANEL WALL CONSTRUCTION

PRIOR APPLICATIONS

This continuation-in-part application is directed to subject matter disclosed but not specifically claimed in my pending patent application Ser. No. 13,910, filed Feb. 22, 1979 which in turn is a continuation of my U.S. patent application Ser. No. 754,756, filed Dec. 27, 1976, now abandoned.

BACKGROUND

This invention is directed primarily to an insulated panel wall construction for the exterior of buildings. However, the construction described has utility for interior walls. A typical technique for applying panels or facings to a building wall has been to secure panels directly to the structural members or girts of the building with an intermediate layer of an insulating material. This construction has a serious drawback; namely, the insulating material being crushable does not permit a suitable rigid fastening between the panel and the supporting structures.

Sheet metal panel construction according to this invention have the following advantages: They enable the rigid and positive attachment of the panels to the supporting structure. Moreover, the construction is designed to facilitate assembly thereof under normal working conditions wherein winds may be expected to dislodge panels before they are fastened at each edge. The construction is also designed to hold the panels in place after each end has been fastened even in the face of high winds which create a large negative pressure over the outer face of the panel. The internal positive pressure cannot buckle the panel popping it out of interengagement as explained herein. An added advantage is the workmen assemblying the construction can drill the holes for the fastener without stopping to measure the distance from the edge of the panel to the hole location.

SUMMARY OF THE INVENTION

Briefly according to this invention, a panel wall construction comprises a framework, a plurality of panels and a plurality of locking clips as more specifically claimed. Conventional fasteners, with the cooperation of the clips, hold the panels to the framework.

Constructions according to this invention comprise a framework, preferably, defined by a plurality of spaced standards with horizontal girts fastened thereto. The panels are secured at their fastened edges to the girts by conventional fasteners. At their unfastened edge, each panel interengages the adjacent panel at its fastened edge to form a continuous wall. The basic unit of the wall construction according to this invention is a usually insulated construction panel. The panel is comprised of one sheet metal section which defines an exterior wall and interengaging panel edges. One of the edges is shaped to define a U-shaped socket and is provided with a flange extending away from the socket for receiving fasteners. The other edge is provided with a U-shaped tongue sized to fit in the socket of an adjacent identical panel. Preferredly, the edge of the flange is bent toward the face of the wall section of the panel to define a web. The locking clips which cooperate with the fasteners are essentially flat sheet metal pieces that have one edge portion bent upwardly to define a resilient tab. The clips are provided with an opening through the flat portion through which a fastener can pass. According to a preferred embodiment, the clip has a folded over portion along the edge opposite the resilient tab. In this case, the foldover portion is sized and configured to slide over the web along the edge of the panel flange such that the flat portion of the clip abuts the flange of the panel and the resilient tab is bent away from the flange toward the U-shaped socket. The foldover portion of the locking clip is sufficiently crimped such that it may be slipped over the web but remains by friction where put so long as not interferred with.

THE DRAWINGS

Further features and other objects and advantages of this invention will become apparent to one skilled in the art from a study of the following detailed description made with reference to the drawings, in which.

DESCRIPTION OF PREFERRED EMBODIMENTS

Figure 1:
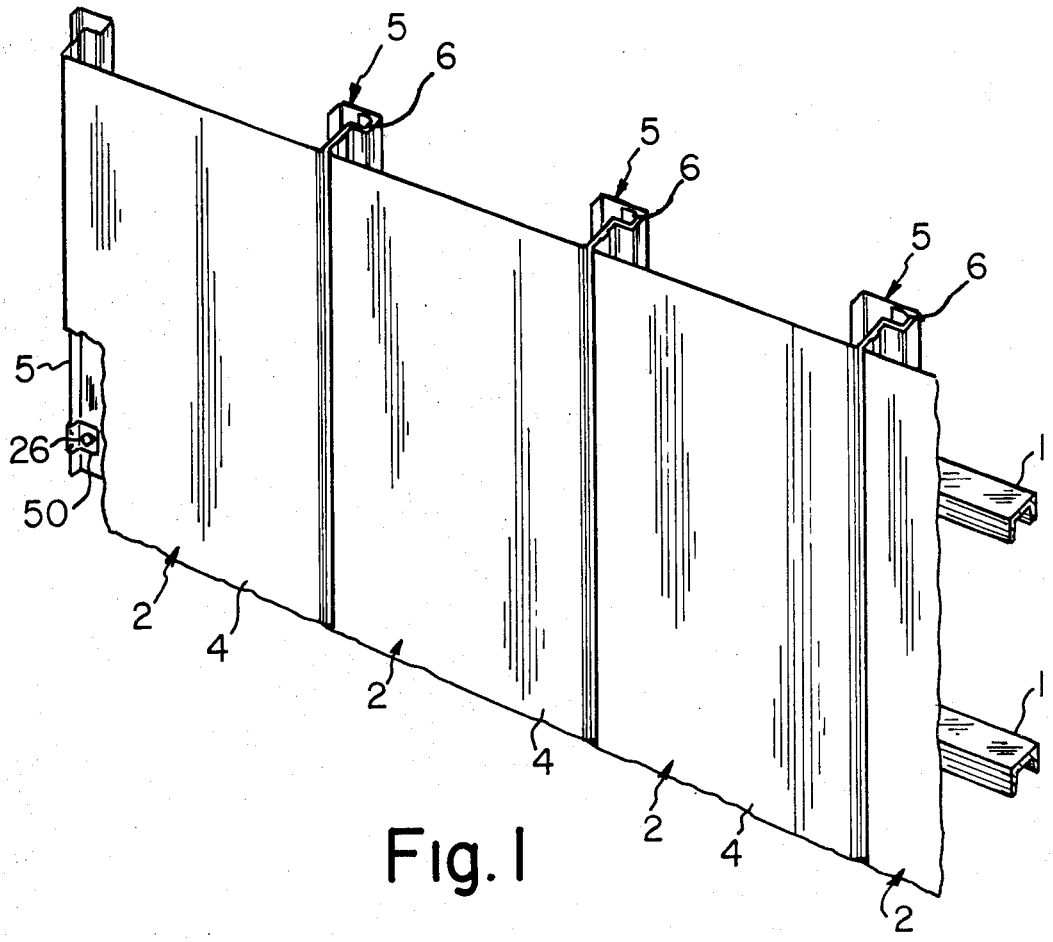
FIG. 1 is an overall pictorial view of an insulating panel wall construction according to this invention.

Referring now to FIG. 1, panel wall constructions according to this invention comprise a plurality of spaced support members 1. They are, however, generally horizontal girts as shown. Secured to the girts are panels 2 having external faces 4 and interengageable edges 5 and 6. The panels are secured at one edge to the girts by suitable fasteners such as screws or bolts 26.

Figure 2:
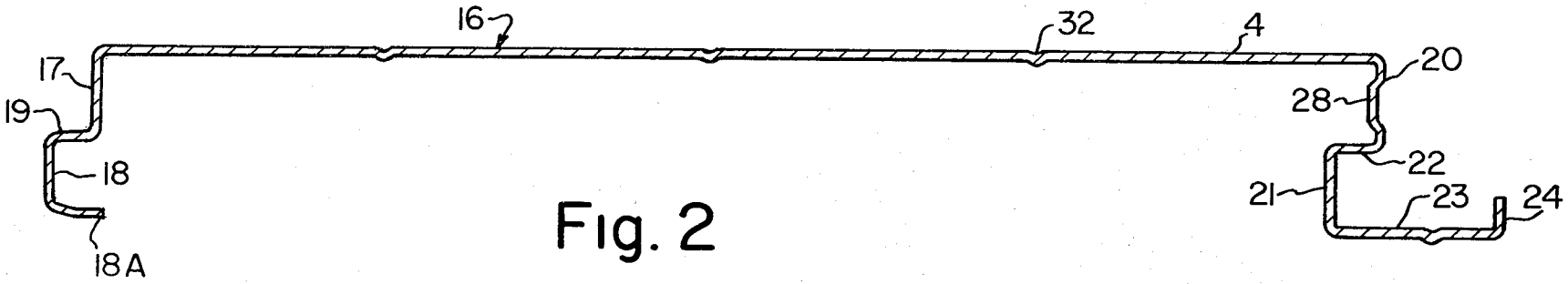
FIG. 2 shows an embodiment of a sheet metal section for insulated panels according to this invention.

Referring now to FIG. 2, it is permissible according to this invention that the sheet metal sections 16 have ornamental configurations. Longitudinal beads 32 may add decoration to flat areas of panels such as shown in FIG. 2 and at the same time provide additional rigidity to the panels.

The panel section has an exterior face 4 and an end face 17 joining therewith near the unfastened edge at one end. A generally U-shaped tongue 18 joins the end face 17. The surface 19 on the tongue 18 which is generally parallel to the face 4 and facing in the same direction is a bearing surface. An end face 20 joins the exterior face 4 near the fastening edge. A generally U-shaped socket 21 is secured to end face 20 and has a bearing surface 22 substantially parallel to the face 4 and facing in the opposite direction. Extending from the socket is a joining or fastening flange 23 which bears against the girt. The joining flange has a turned-up edge portion defining web 24. It should be understood that the U-shaped tongues and U-shaped sockets may, without deviating from the scope of the invention, be curvilinear or rectangular. They must, of course, be complementary to the extent hereinafter explained.

Figure 3:
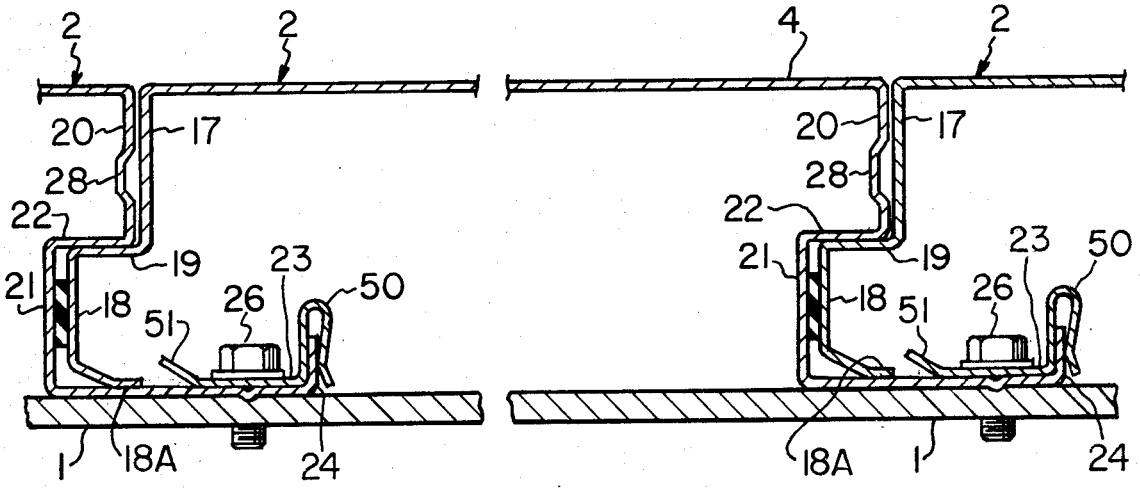
FIG. 3 is a section view of an embodiment of this invention with adjacent interengaging panels shown.

Referring now to FIG. 3, a panel according to this invention is shown in relation to adjacent interengaging panels. The bearing surfaces on the fastened edge of the panel abut the bearing surfaces of the interengaging unfastened edge of the adjacent panel.

The interengaging edges must be substantially complementary, that is, having abutting bearing surfaces and abutting peripheral or side faces. They may also provide for various sealing devices. According to yet another preferred embodiment of this invention, at least one end face at each edge of the panel has a siphon break 28 to allow any water which might seep into the junction between the interengaging panels to drop down rather than to go on through the panel.

Figure 4:
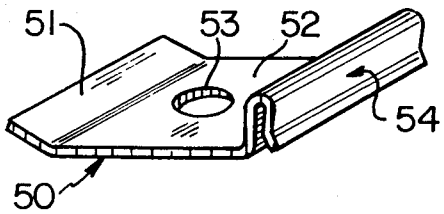
FIG. 4 is an oblique view of a clip used to secure the panels in a wall construction according to this invention.

Referring now to FIG. 4, the clip 50 is provided with a flat portion 52, preferably having a predrilled opening 53. Along one edge, the clip is bent upward to form a resilient tab 51. The tab 51 forms an angle between about 15 and 45 degrees with the flat portion 52. The edge portion opposite the tab is bent, folded and crimped to form a clip portion 54. Clip 50 is designed to fit over web 24 of flange 23 and to be held by fastener 26. Free end (resilient tab) 51 does not normally engage the unfastened edge of the panel. However, when the panel is buckled outward due to the differential pressures across the panel face during a heavy wind, the unfastened edge may be drawn into engagement with the clip thereby securing the edge of the panel and preventing it from disengaging. Otherwise, it would be possible for the wind across the panel face to cause the unfastened edge to pop out of position. The length of tab 51 and the flange 18A comprising part of the U-shaped tongue portion 18 of each panel are sized so that the edge of the flange 18A can be urged past the edge of the tab 51 when the panels are being interengaged. When the edge of the flange 18A is worked past the end of the tab, the tab snaps back for securing the tongue 18 should it be pulled away from the socket 21 of the adjacent panel.

Panel wall constructions are assembled, after the girts defining the framework have been emplaced. The first panel is aligned and held in place. The clips are slipped over the web 24 of the panel flange 23 at the location of each girt and held in place by friction. A hole is then drilled through flange 23 into the girt to permit the emplacement of a fastener. Because the clip stays put, especially if it is predrilled, the drilling of the flange and girt are simplified. Once drilling is completed, the fasteners are emplaced thus securing the first panel at its normally fastened edge. Thereafter, the next panel is positioned by inserting the U-shaped tongue of the next panel into the U-shaped socket of the already fastened panel.

The crimped portion of the locking clip is important not only for clamping the clip during the drilling and fastening operation. It is also important for preventing rotation of the clip about the fastener. This insures that the edge of the tab is always properly aligned for its snap locking function.

The panel sections may be made from any suitable material which is capable of being formed to the configurations described. It is preferred that the panels be stamped or continuously roll-formed out of light gauge sheet metal such as galvanized steel, aluminum, stainless steel, or aluminized steel. To resist corrosion and to add decoration such as color, the steels may be coated, for example, with vinyl or silicon polyster or other coatings or films. Suitable materials include 18 to 24 gauge aluminum and stainless steel, 18 to 24 gauge aluminized steel and carbon steel, electro-zinc coated and painted and other types of sheet materials.

Any suitable insulation can be incorporated into the panels as described, for example, fiberglass insulation, polystyrene insulation, foamed insulations or others which may be available. The insulation may be in the form of bats laid in place before any interior and exterior sheet metal sections are joined. On the other hand, the insulation may be a foam resin placed into the assembled panel and allowed to expand and solidify in situ or a combination of the two. It should be understood that other insulating techniques are available and useful in this invention.

Having thus described the invention with the detail and particularity as required by the Patent Laws, what is desired protected by Letters Patent is set forth in the following claims.

I claim:

1. A panel wall construction comprising:

a plurality of spaced girts defining a framework, a plurality of construction panels comprising sheet metal sections, said sections defining walls and having opposite interengaging panel edges, one of said edges shaped to define a u-shaped socket and provided with a flange extending away from the socket, the other edge provided with a U-shaped tongue, said panels being secured to the girts by fasteners passing through said flange, each of said panels interengaging adjacent panels to form a continuous wall; and a plurality of clips held against the flange by said fasteners, each of said clips having a flexible tab bent upwardly from said flange and extending toward said socket such that an unfastened panel may be moved into place by inserting the U-shaped tongue into the U-shaped socket whereby the tab is depressed until the tongue has moved past it toward the socket and then the tab snaps to its undepressed original position for securing the tongue should it be pulled away from the socket.

2. A panel wall construction comprising:

a plurality of spaced girts defining a framework, a plurality of construction panels comprising sheet metal sections, said sections defining walls and having opposite interengaging panel edges, one of said edges shaped to define a U-shaped socket and provided with a flange extending away from the socket, the edge of the flange being bent to form a narrow web extending upwardly from said flange, the other edge provided with a U-shaped tongue, said panels being secured to the girts by fasteners passing through said flange, each of said panels interengaging adjacent panels to form a continuous wall; and a plurality of clips held against the flange by said fasteners, each of said clips having a folded edge for clamping over the web of the flange on the panels and a flexible tab along the other edge of the clip bent upwardly from said flange and toward said socket such that an unfastened panel may be moved into place by inserting the U-shaped tongue into the U-shaped socket whereby the tab is depressed until the tongue has moved past it toward the socket and then the tab snaps to its undepressed original position for securing the tongue should it be pulled away from the socket.

* * * * *